US011541424B2

(12) United States Patent
Giersemehl et al.

(10) Patent No.: US 11,541,424 B2
(45) **Date of Patent: *Jan. 3, 2023**

(54) SEPARATOR AND MILL WITH A SEPARATOR

(71) Applicant: NEUMAN & ESSER PROCESS TECHNOLOGY GMBH, Übach-Palenberg (DE)

(72) Inventors: Marc Giersemehl, Krefeld (DE); Thomas Mingers, Übach-Palenberg (DE); Joachim Galk, Gangelt-Birgden (DE)

(73) Assignee: NEUMAN & ESSER PROCESS TECHNOLOGY GMBH, Übach-Palenberg (DE)

( * ) Notice: Subject to any disclaimer, the term of this patent is extended or adjusted under 35 U.S.C. 154(b) by 388 days.

This patent is subject to a terminal disclaimer.

(21) Appl. No.: 16/349,333

(22) PCT Filed: Nov. 2, 2017

(86) PCT No.: PCT/EP2017/078058
§ 371 (c)(1),
(2) Date: May 13, 2019

(87) PCT Pub. No.: WO2018/091275
PCT Pub. Date: May 24, 2018

(65) Prior Publication Data

US 2019/0291138 A1 Sep. 26, 2019

(30) Foreign Application Priority Data

Nov. 15, 2016 (DE) ..... 10 2016 121 927.4

(51) Int. Cl.
*B07B 7/083* (2006.01)
*B02C 23/30* (2006.01)
(Continued)

(52) U.S. Cl.
CPC ..... *B07B 7/083* (2013.01); *B02C 23/08* (2013.01); *B02C 23/30* (2013.01); *B07B 11/04* (2013.01); *B02C 2015/002* (2013.01)

(58) Field of Classification Search
CPC ..... B07B 7/083; B07B 11/04; B02C 23/08; B02C 23/18; B02C 23/30; B02C 23/34;
(Continued)

(56) References Cited

U.S. PATENT DOCUMENTS 4,689,141 A 8/1987 Folsberg
5,238,196 A * 8/1993 Chang ..... B02C 15/001 241/129

(Continued)

FOREIGN PATENT DOCUMENTS

CN 105414034 A 3/2016
DE 805840 C 5/1951

(Continued)

OTHER PUBLICATIONS

Bernotat, S., Stand Der Sichtertechnik-Sichter Fur Massenguter, ZKG International, vol. 43, No. 2, 1990, pp. 81-90, XP000103610.

(Continued)

*Primary Examiner* — Edward T Tolan
*Assistant Examiner* — Smith Oberto Bapthelus
(74) *Attorney, Agent, or Firm* — Hudak, Shunk & Farine Co. LPA

(57) ABSTRACT

A separator having a separator housing, a separator wheel arranged inside the separator housing and having an axis of rotation (X), and a guide vane assembly arranged in the separator housing, an annular space being provided between the guide vane assembly and the separator housing radially (R) perpendicular to the axis of rotation (X) and a separation zone being provided between the guide vane assembly and the separator wheel, and the guide vane assembly having a (Continued)

plurality of vertical guide vanes. In order to increase separation performance, at least one deflecting element is arranged between at least two adjacent vertical guide vanes and has at least one downward-pointing curved and/or bent portion.

12 Claims, 23 Drawing Sheets

(51) Int. Cl.
*B02C 23/08* (2006.01)
*B07B 11/04* (2006.01)
*B02C 15/00* (2006.01)

(58) Field of Classification Search
CPC ..... B02C 13/13; B02C 13/14; B02C 17/1835; B02C 2015/002
USPC ..... 241/47
See application file for complete search history.

(56) References Cited

U.S. PATENT DOCUMENTS 5,425,923 A * 6/1995 Swisher, Jr. ..... F23G 7/14 422/643
5,622,321 A 4/1997 Brundiek et al.
6,827,221 B1 12/2004 Brundiek et al.
8,651,032 B2 2/2014 Otani et al.
8,813,967 B2 8/2014 Plant et al.
10,137,478 B2 11/2018 Hagemeier et al.
2007/0228194 A1 10/2007 Takeno et al.
2010/0236458 A1* 9/2010 Otani ..... B02C 15/04 110/232
2012/0138718 A1* 6/2012 Daimaru ..... B07B 7/08 241/79

FOREIGN PATENT DOCUMENTS

DE 4423815 C2 9/1996
EP 1153661 A1 * 11/2001 ..... B07B 7/083
EP 1153661 A1 11/2001
EP 1239966 B1 1/2005
EP 2659988 B1 10/2015
GB 1049306 11/1996
GB 2412888 A 12/2005
JP 2005324104 A 11/2005
JP WO2009041628 A1 1/2011
KR 870000091 A 2/1987
WO 2014124899 A1 8/2014

OTHER PUBLICATIONS

Japanese Office Action for family member application No. 2019-546979 dated Aug. 30, 2021.
Chinese Office Action for family member application No. 2017-800691779 dated Aug. 30, 2021.
Korean Office Action cited in corresponding Korean Application 10-2019-7013095 dated Mar. 7, 2022.
Korean Office Action of corresponding Korean Application 10-2019-7013095 dated Oct. 24, 2022.

* cited by examiner

SEPARATOR AND MILL WITH A SEPARATOR

FIELD OF THE INVENTION

The present invention relates to a separator having a separator housing, a separator wheel arranged inside the separator housing and having an axis of rotation (X), and a guide vane assembly arranged in the separator housing, wherein an annular space is provided between the guide vane assembly and the separator housing in the radial direction (R) perpendicular to the axis of rotation (X) and a separation zone is provided between the guide vane assembly and the separator wheel, wherein the guide vane assembly comprises a plurality of vertical guide vanes as well as a mill with such a separator.

BACKGROUND OF THE INVENTION

By separation is meant in general the sorting of solids according to certain criteria such as mass density or particle size. Winnowing is a group of separation processes in which a gas stream, the so-called separating air, is used to accomplish this sorting. The active principle is based on that fact that fine or small particles are influenced more strongly and carried along by the gas stream than are large or coarse particles.

Wind separators are used for example for the classifying of coal dust and other grist of a mill. The goal here is to separate particles which have been ground sufficiently small after the grinding process from particles needing further grinding. These two particle groups are also called fines and tailings. Basically, a separator may also be used for the sorting or classifying of solids of different origin.

There are various kinds of wind separators. A major distinguishing criterion is the manner in which the solid substance being separated, or the feedstock, and the separating air are introduced into the separator. Thus, solids and separating air may either be introduced separately from each other or jointly.

A wind separator, in which solids and separating air are introduced jointly, is known from US 2010/0236458 A1. The disclosed wind separator is used for sorting of coal dust. The mixture of coal dust and separating air is admitted to the separator housing from underneath. The inlet volume flow of the gas-solids mixture flows entirely from the outside into the interior of a guide vane assembly. The guide vane assembly has a multitude of deflecting elements, between which the mixture flows. The deflecting elements are tilted relative to the horizontal by 50 to 70° and secured. Inside the guide vane assembly is situated a separator wheel. The separator wheel is driven in rotation and has a multitude of fins, running substantially vertically. Fine particles by virtue of the flow and despite the rotation of the separator wheel can get in between the fins of the separator wheel and are afterwards sucked out at the top. Coarse particles, on the other hand, strike against the fins and are bounced back in this way and finally drop down because of gravity.

Another separator with deflecting elements tilted to the horizontal is the louver separator of type LJKS, known from the article "State of the art of separator technology—separators for bulk goods" by S. Bernotat, appearing in ZKG International 43 (1990) February, No. 2, Wiesbaden, DE.

In other wind separators the guide vanes of the guide vane assembly are arranged vertically, such as in WO 2014/124899 A1. The guide vanes proposed there may be straight or curved. Similar wind separators are also known from the publications EP 1 239 966 B1, EP 2 659988 A1, DE 44 23 815 C2 and EP 1 153 661 A1. In the case of EP 2 659 988 A1, the fins are adjustable.

In EP 1 153 661 A1, both vertical and horizontal fins are used, which on the whole should result in a more uniform flow. Furthermore, the horizontal partitioning of the flow path should have the effect that the flow is directed at the separator wheel along its entire height, which should help improve the separating efficiency.

A mill with an integrated separator is known from US 2012/0138718 A1.

However, the deflecting elements of US 2010/0236458 A1 and the fins of EP 1 153 661 A1 represent a kind of obstacle to the flow. Especially in US 2010/0236458 A1, the mixture of feedstock and separator air flows almost vertically against the deflecting elements. In this way, a backflow or a swirling of the mixture may occur before flowing into the guide vane assembly.

SUMMARY OF THE INVENTION

The solutions known in the prior art are therefore not adequate to making possible a controlled entry of the mixture of feedstock and separator air into the separating zone between the guide vane assembly and the separator wheel. The separating efficiency of the process will suffer from the uncontrolled entry.

The problem which the invention proposes to solve is to improve the sorting efficiency of separators in which the feedstock and the separating air are introduced jointly.

This problem is solved by a separator having a separator housing, a separator wheel arranged inside the separator housing and having an axis of rotation (X), and a guide vane assembly arranged in the separator housing, wherein an annular space is provided between the guide vane assembly and the separator housing in the radial direction (R) perpendicular to the axis of rotation (X) and a separation zone is provided between the guide vane assembly and the separator wheel, wherein the guide vane assembly comprises a plurality of vertical guide vanes, wherein at least one deflecting element is arranged between at least two adjacent vertical guide vanes and has at least one downward-pointing curved and/or bent portion. The problem is also solved with a mill, especially a pendulum mill or roller mill, including the separator.

Advantageous modifications are the subject matter of the dependent claims.

The separator according to the invention has a separator housing. In the separator housing there are arranged a separator wheel having an axis of rotation X and a guide vane assembly. An annular space is provided between the guide vane assembly and the separator housing in the radial direction R perpendicular to the axis of rotation X and a separating zone is provided between the guide vane assembly and the separator wheel.

The axis of rotation X preferably extends in the vertical direction.

The invention is characterized in that at least one deflecting element is arranged between at least two adjacent vertical guide vanes and has at least one downward pointing curved and/or bent portion. Thanks to the downward pointing curved and/or bent portion, controlled channeling of the gas-solids mixture into the separating zone of the separator is possible. By a bent portion is meant an angled straight segment of the deflecting element.

Preferably, at least one deflecting element is arranged between every two neighboring vertical guide vanes.

The benefit of these deflecting elements is that the flow of the gas-solids mixture can additionally be imparted a horizontal and/or vertical downward directed movement component already inside the guide vane assembly. This results inside the separating zone in a better presentation of the flow to the separator wheel, which in turn heightens the separating efficiency of the separator.

If a multitude of deflecting elements are provided in a separator, the deflecting elements may either be identical or different. Preferably, all deflecting elements inside a separator are identical, so that the production costs can be lowered. However, it may be advantageous to use deflecting elements of different configuration in a separator, in order to produce different effects at different places inside the separator.

Features which are described in the following with respect to one deflecting element may also be used in other deflecting elements in the very same embodiment of a separator according to the invention and preferably in all deflecting elements of this embodiment.

Separators of this kind are generally arranged upright. Therefore, in the following, directions parallel to the direction of the force of gravity shall be called "vertical".

Accordingly, directions perpendicular to the direction of the force of gravity shall be called "horizontal".

Advantageously, at least one of the deflecting elements extends over the entire width between two neighboring guide vanes. In this way, regions inside the guide vane assembly where an uncontrolled flow into the separating zone might occur are avoided.

In advantageous modifications it is provided that at least one of the deflecting elements extends from the guide vane assembly into the separating zone and/or into the annular space. In particular, an extension into the annular space is advantageous, since in this case the gas-solids mixture already strikes against the deflecting elements in the annular space and is deflected. This results in a very controlled inflow of the gas-solids mixture into the separating zone.

In order to enable a uniform deflecting, one of the deflecting elements has a variable radius of curvature at least in one partial section in the radial direction R of the guide vane assembly. Preferably, at least one of the deflecting elements has a variable radius of curvature over the entire length in the radial direction R.

Advantageously, at least one of the deflecting elements has a radial inner end with a first end section and/or a radial outer end with a second end section. The terms radial inner and radial outer refer here to the guide vane assembly. The guide vane assembly preferably has a cylindrical basic form. The end sections may be configured in different ways, as shall be explained more closely in the following.

One end section comprises preferably less than 40%, especially less than 20% of the overall length of a deflecting element.

In advantageous modifications of the separator, at least one of the end sections is straight. A section is straight if it has no curvature. This configuration is advantageous especially for the first end section of the radial inner end. At the radial inner end, the gas-solids mixture should flow as homogeneously as possible in the direction of the separator wheel. The straight configuration of the first end section favors a homogeneous flow.

Straight end sections are preferably bent, i.e., angled, and thus form bends.

Preferably, at least one of the end sections is arranged horizontally. Especially preferably, this is the first end section of the radial inner end. This also serves for generating a homogeneous flow in the direction of the separator wheel.

In advantageous modifications it is provided that at least one of the second end sections or its tangential prolongation runs at an angle $\alpha$ to a horizontal H, whereby $\alpha \geq 20°$. The second end sections are arranged each time at an outer end of the deflecting elements. The gas-solids mixture when used as intended arrives from below at the deflecting elements. Therefore, it is especially advantageous for the second end sections to be directed downward at an angle $\alpha$ greater than or equal to 20°. Especially preferably, moreover, $\alpha \leq 60°$.

A tangential prolongation means a straight prolongation of an arc-shaped section which is tangential to the curvature at an end point of the section. The arc-shaped section is preferably viewed in cross section for the determination of the tangential prolongation.

The extent of the deflection of the gas-solids mixture has an influence on the separating efficiency. If the deflection is too great, swirling or back flow may be formed.

Too little a deflection will have no effect.

In advantageous modifications of the invention it is therefore provided that the first end section of at least one of the deflecting elements or its tangential prolongation and the second end section of the same deflecting element or its tangential prolongation run together at an angle $\beta$, where $\beta \geq 90°$. In particular, $\beta \geq 120°$. Especially preferably, moreover, $\beta \leq 160°$.

Depending on which solid is being sorted and what the particle distribution is in the gas-solids mixture, it may be advantageous to arrange the first end section at an angle greater than 0° to the horizontal H. In advantageous modifications, it is provided that at least one of the first end sections or its tangential prolongation runs at an angle $\gamma$ to the horizontal H, while: $\gamma \geq 10°$. In order to prevent increased coarse material from ending up in the fine material, the gas-solids mixture can be deflected downward in this way by the deflecting element and thus in the direction in which the coarse material will ultimately end up. However, the angle $\gamma$ should not be chosen too large. Preferably, $\gamma \leq 45$, especially $\gamma \leq 30$.

Regarding the angles $\alpha$, $\beta$ and $\gamma$ it is especially preferable for: $\alpha+\beta+\gamma=180°$. Preferably, the angles are situated beneath the same horizontal H.

It has been found that already with one deflecting element between every two neighboring vertical guide vanes it is possible to achieve good results in terms of the flow relations.

In advantageous modifications of the separator it is provided that there are arranged at least three to five deflecting elements between every two neighboring vertical guide vanes. In this way, the gas-solids mixture flowing between two neighboring vertical guide vanes is divided into partial streams, so that swirling is avoided and the streams become homogenized.

Preferably, at least one vertical flap element extending into the separating zone is arranged on the inner circumference of the guide vane assembly. The vertical flap element or elements have the benefit that they can adjust in even more targeted manner the flow of the gas-solids mixture coming from the guide vane assembly into the separating zone. The benefit of the flap elements is that the flow can be additionally imparted a swirl, especially in the direction of rotation of the separator wheel.

Preferably, the flap element can swivel about a vertical axis.

Preferably, the flap element is arranged on the inner end face of the vertical guide vane.

Preferably, the length of the flap element is equal to the length of the vertical guide vane. The flap element in one special embodiment is rectangular in configuration.

Preferably, the flap element has at least one horizontal slot. This configuration is used when the deflecting elements also extend into the separating zone. The number of horizontal slots preferably depends on the number of deflecting elements. The width of the slots is adapted to the configuration, i.e., the curvature and/or bending of the first end sections of the deflecting elements.

Preferably, at least one flap element has a curvature and/or a bending.

The curvature or bending of the flap element preferably points in the direction of the inner circumference of the guide vane assembly.

The remarks about the features of the curvature and bending, as well as those on the embodiments in connection with the deflecting elements, also hold for the flap elements. These embodiments of the flap elements have the benefit that the flow through the guide vane assembly can be adjusted in even more targeted manner.

Advantageously, the annular space tapers toward the top. Due to the flowing of the gas-solids mixture through the guide vane assembly, the volume flow gradually decreases, so that it is advantageous for the volume of the annular space to decrease steadily toward the top. This is accomplished thanks to the tapering.

In advantageous modifications, the guide vane assembly has at least one swirl breaker. Swirl breakers prevent a flow in the circumferential direction of the guide vane assembly and in this way homogenize the flow of the gas-solids mixture.

The problem is also solved with a mill which is combined with a separator according to the invention. The mill is preferably a pendulum mill or a roller mill. Preferably, the separator is integrated in the mill, preferably a pendulum mill or a roller mill.

BRIEF DESCRIPTION OF THE DRAWINGS

The invention shall be represented and explained with the aid of the figures as an example. There are shown.

DETAILED DESCRIPTION OF THE INVENTION

Figure 1:
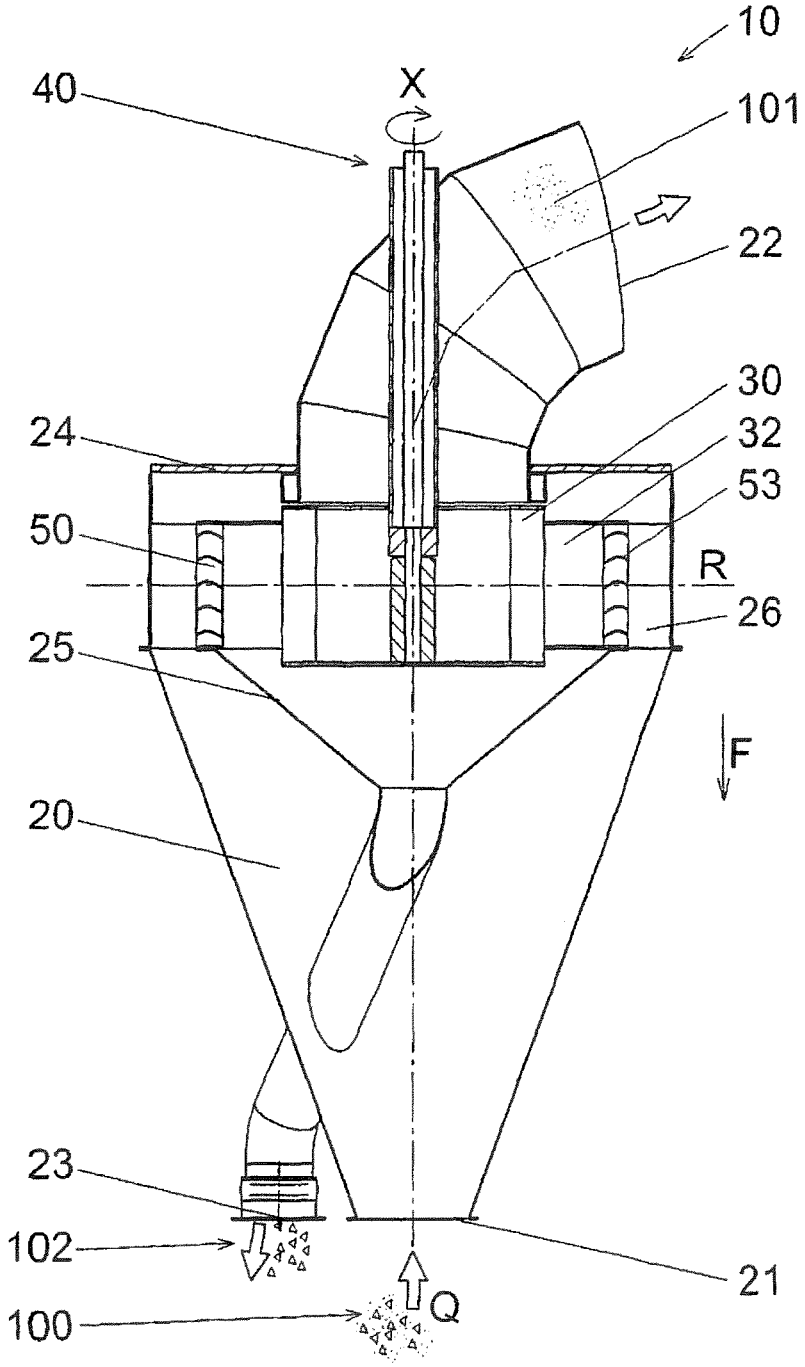
FIG. 1 a schematic side view of a separator in cross section.

FIG. 1 shows a separator 10 in schematic representation. The separator 10 comprises a separator housing 20, in which in a lower region there is provided an inlet 21 for a volume flow Q of a gas-solids mixture 100.

In the separator housing 20 there are arranged a separator wheel 30 and a guide vane assembly 50. The separator wheel 30 and the guide vane assembly 50 have a common principal axis, which is the axis of rotation X for the separator wheel 30. The axis of rotation X extends in the direction of the force of gravity F. Perpendicular to the axis of rotation X extends a radial direction R. Between the guide vane assembly 50 and the separator housing 20, an annular space 26 is provided in the radial direction R. The space between the separator wheel 30 and the guide vane assembly 50 forms the separating zone 32. The guide vane assembly 50 is studded with deflecting elements 53, having a downwardly pointing curvature. The deflecting elements 53 shall be described more closely in particular in connection with FIGS. 12 to 18.

The separator wheel 30 is driven in rotation by a drive device 40, so that the separator wheel 30 turns about the axis of rotation X.

Above the separator wheel 30 there is arranged a first outlet 22. The first outlet 22 is connected to a suction mechanism (not shown), which creates a negative pressure. A first particle variety 101, the fine material, is sucked through the first outlet 22 when the device is used as intended.

Beneath the separator wheel 30 there is arranged a funnel 25, which empties into a second outlet 23. A second particle variety 102, the coarse material, is taken away through the second outlet 23 when the device is used as intended. The separator wheel 30 rejects large particles 102. These large particles get into the funnel 25 and from there go to the second outlet 23.

The separator housing 20 is closed at the top end by a housing cover 24.

Figure 2:
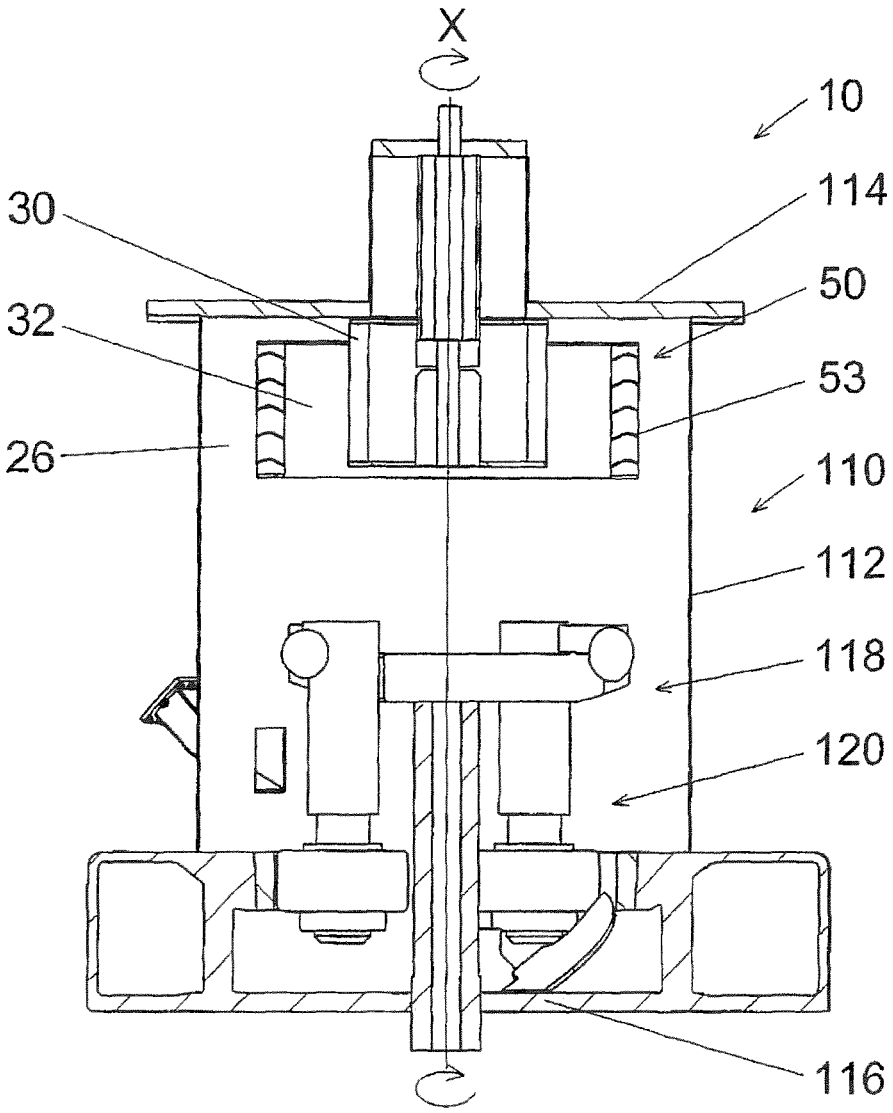
FIG. 2 a mill with integrated separator per FIG. 1 in cross section.

FIG. 2 shows a mill 110, which is designed as a pendulum mill. Inside the housing 112, which is closed off on top by a mill cover 114 and at the bottom by means of a mill floor 116, there is located a milling mechanism 118, comprising several milling pendulums 120. Through the milling mechanism 118, the separator 10 is integrated into the mill housing. Between the mill housing 112 and the guide vane assembly 50 there is situated the annular space 26.

Figure 3:
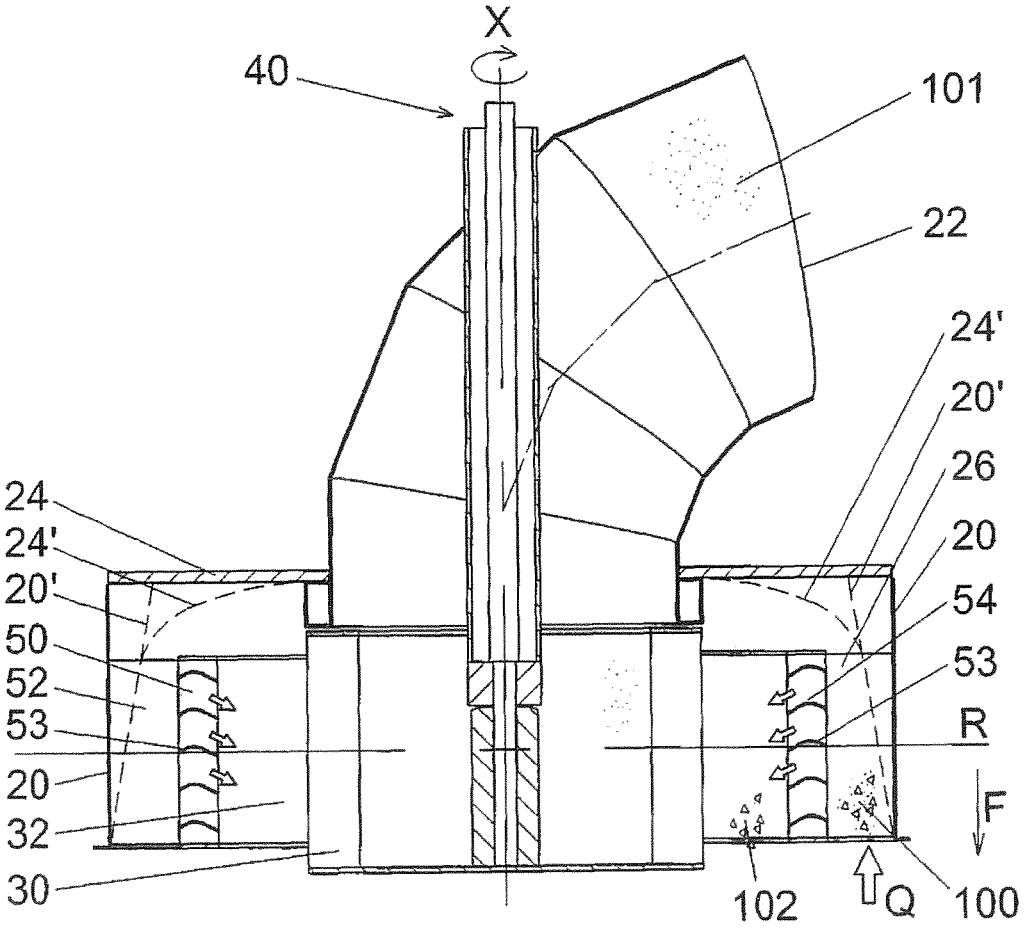
FIG. 3 a schematic side view of the upper section of the separators of FIG. 1 partly in cross section.

FIG. 3 shows the top part of the separator 10. The separator wheel 30 is situated inside the guide vane assembly 50. Between the separator wheel 30 and the guide vane assembly 50 there is situated a separating zone 32. The cylindrical separator housing 20 can also be conical in design. With such a conical separator housing 20' (shown by broken line), an upwardly tapering annular space 26 is formed.

The first outlet 22 communicates with the interior space of the separator wheel 30.

The guide vane assembly 50 has a multitude of vertical guide vanes 54. Five deflecting elements 53 are arranged between neighboring vertical guide vanes 54, each of them having a downwardly pointing curvature.

The volume flow Q of the gas-solids mixture 100 flows from the bottom into the annular space 26 and from there through the guide vane assembly 50 into the separating zone 32. Fine particles 101 get into the interior of the separator wheel 30 and are sucked through the first outlet 22. Coarse particles 102 fall downward and out from the separating zone 32. The deflecting elements 53 impart flow components directed at the separator wheel to the gas-solids mixture flowing through the guide vane assembly 50, as indicated by the arrows drawn.

Figure 4:
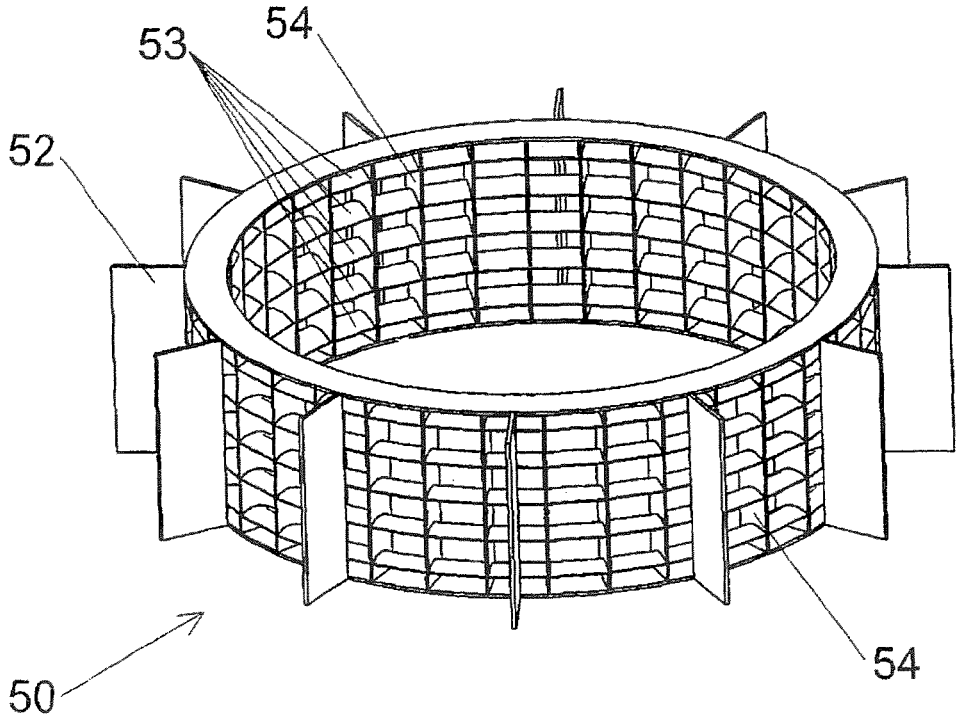
FIG. 4 a guide vane assembly in perspective representation.
Figure 5:
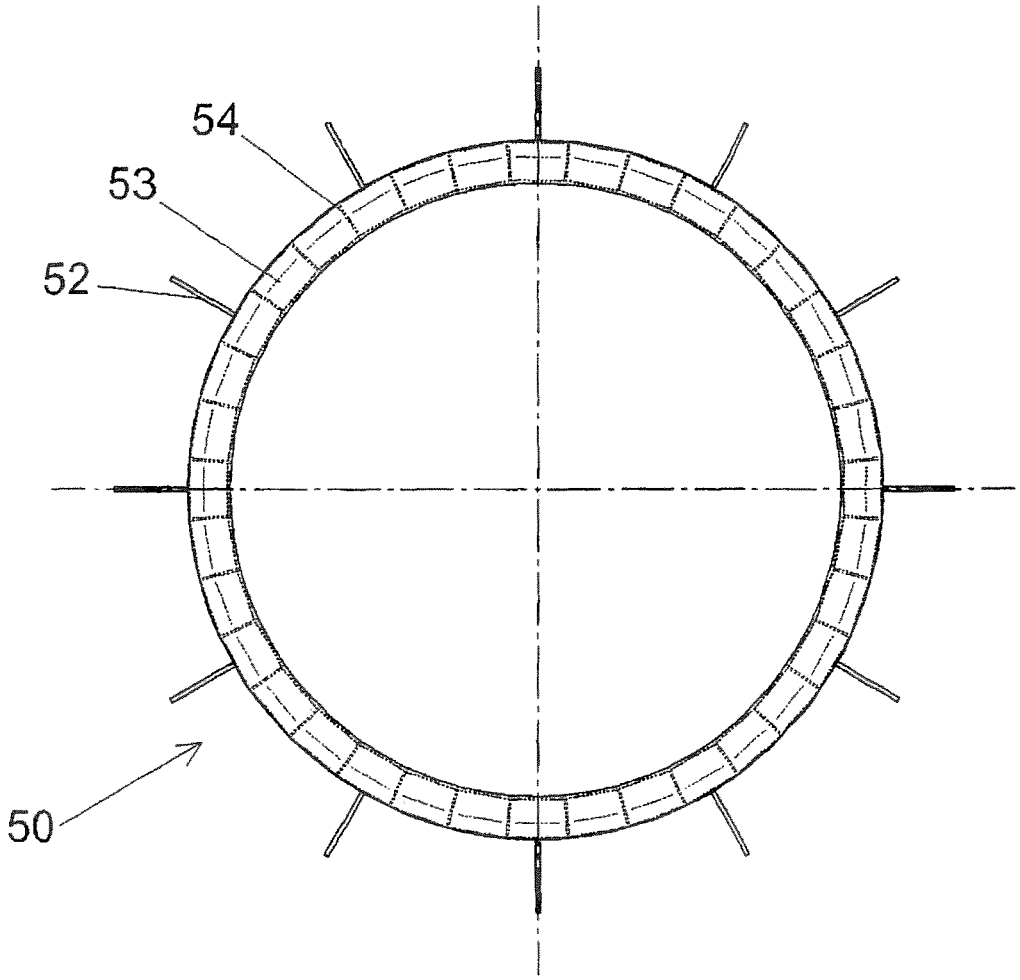
FIG. 5 the guide vane assembly of FIG. 4 in a top view.

FIG. 4 shows the guide vane assembly 50 of FIG. 3 in a perspective representation. FIG. 5 shows a top view of the guide vane assembly 50 represented in FIG. 4.

The guide vane assembly 50 has a plurality of vertical guide vanes 54, with five deflecting elements 53 being arranged between every two neighboring guide vanes 54.

Each deflecting element 53 extends across the entire width between two vertical guide vanes 54. The deflecting elements 53 are arranged equidistant in the vertical direction.

On its outer circumferential surface the guide vane assembly 50 has a multitude of swirl breakers 52. The swirl breakers 52 protrude into the annular space 26 (see FIG. 1) and oppose a flow in the circumferential direction. The swirl breakers 52 have a rectangular basic form and are made of sheet metal. The swirl breakers 52 stand off in the radial direction R from the guide vane assembly 50 and extend across the entire height of the guide vane assembly.

Figure 6:
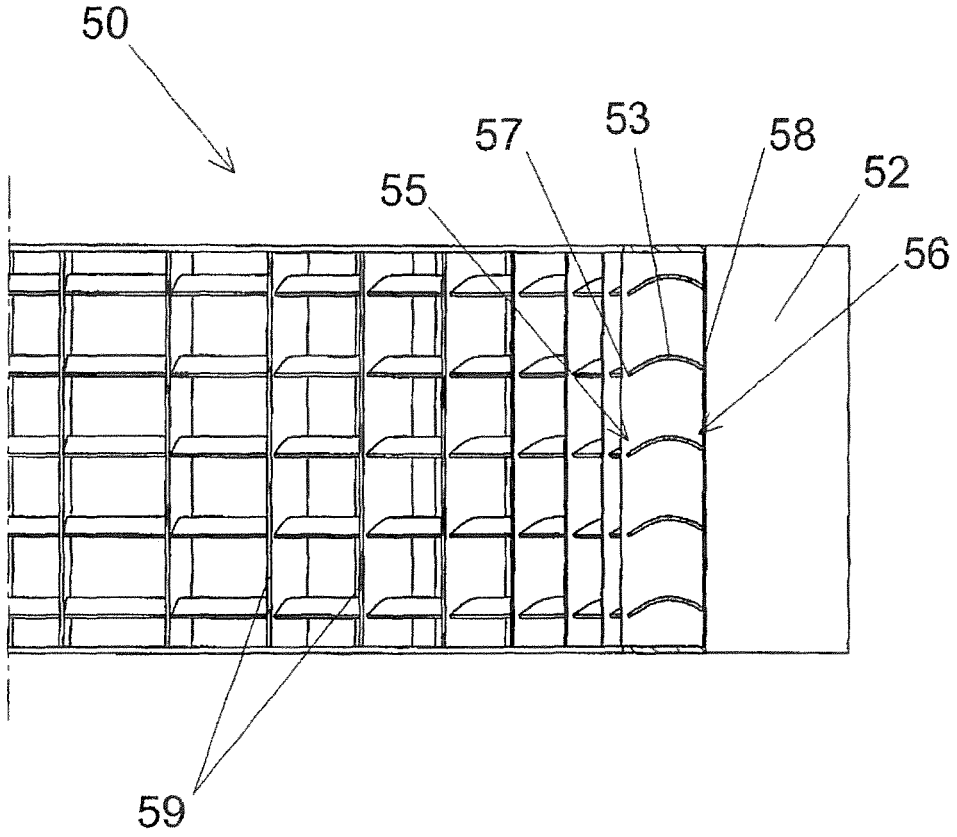
FIG. 6 an enlarged cut-out of the guide vane assembly shown in FIGS. 4 and 5.

FIG. 6 shows an enlarged cut-out of the guide vane assembly 50 represented in FIG. 4.

The deflecting elements 53 have a downwardly pointing curvature. Each deflecting element 53 has a radial inner end 55 and a radial outer end 56. The radial inner ends 55 do not protrude into the separating zone 32 in the embodiment shown.

A first end section 57 is arranged at the radial inner end 55 of each deflecting element 53 and a second end section 58 is arranged at the radial outer end 56 of each deflecting element 53. The two end sections 57, 58 are curved.

Figure 7:
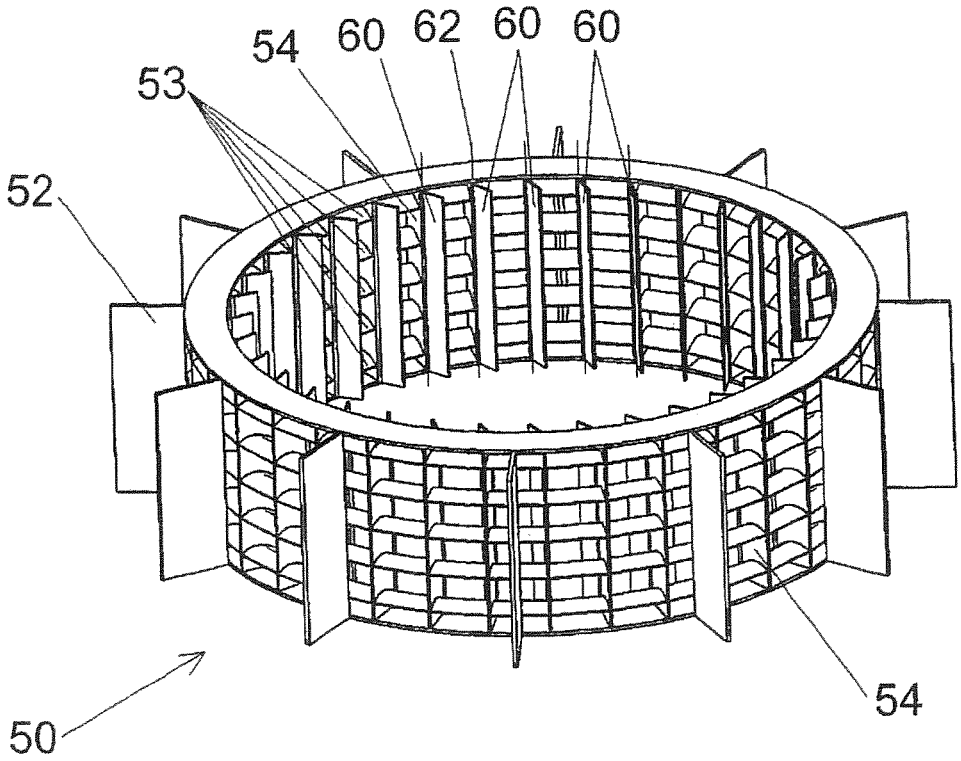
FIG. 7 a guide vane assembly according to another embodiment in a perspective representation.
Figure 8:
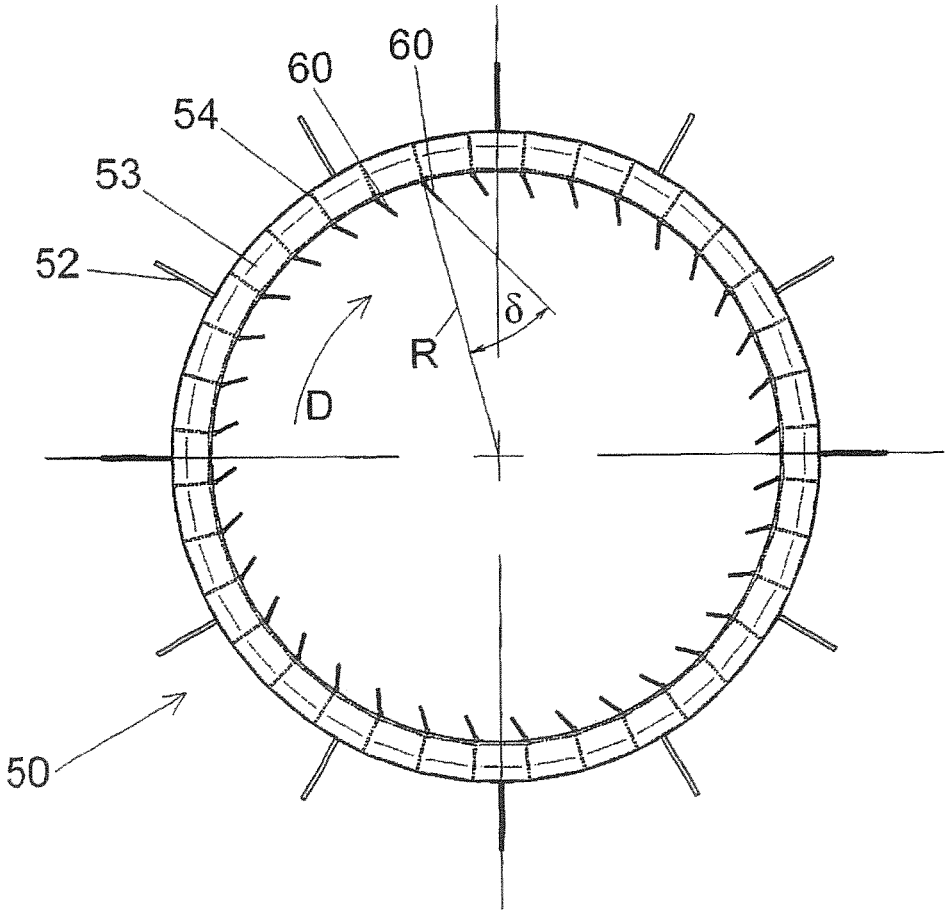
FIG. 8 the guide vane assembly of FIG. 7 in a top view.

FIG. 7 shows another embodiment of the guide vane assembly 50 in a perspective representation. FIG. 8 shows the top view of the guide vane assembly 50 represented in FIG. 7.

Flap elements 60 are arranged in addition on the inside of the guide vane assembly 50, which can swivel about a vertical axis 62. In the embodiment shown, these flap elements 60 are arranged on the inner end face 59 (see FIG. 6) of all vertical guide vanes, being swiveled in the direction of rotation D and forming with the radial direction R an angle δ.

The angle δ in the embodiment shown here is 30°. Preferably, the angle δ lies in the range of 0° to 60°.

Figure 9:
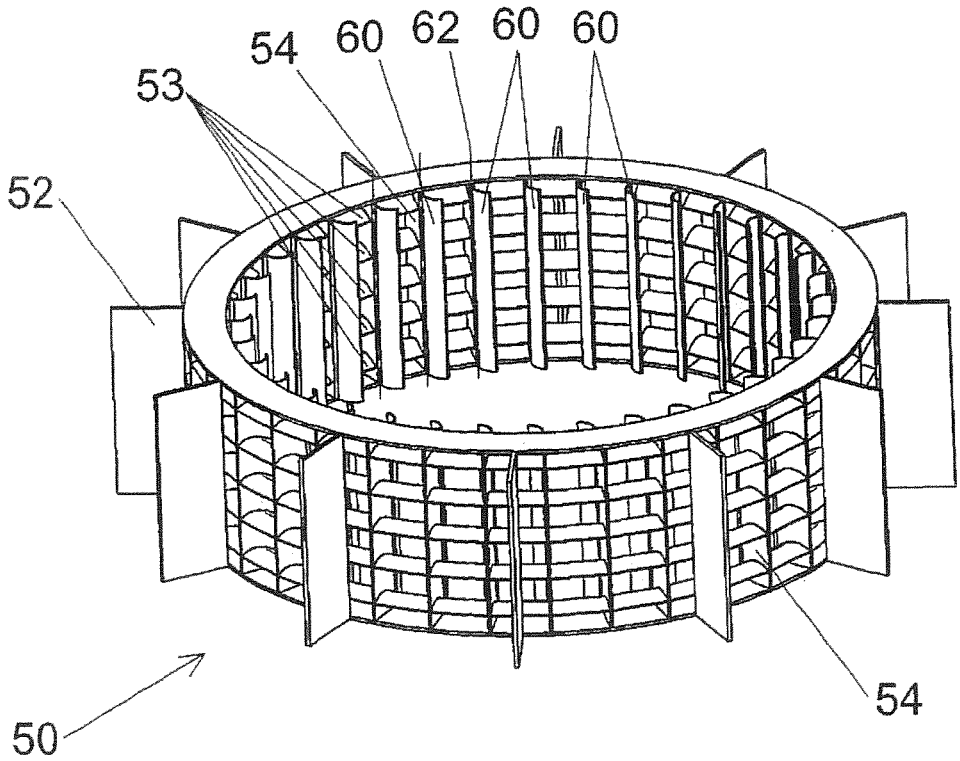
FIG. 9 a guide vane assembly according to another embodiment in a perspective representation.
Figure 10:
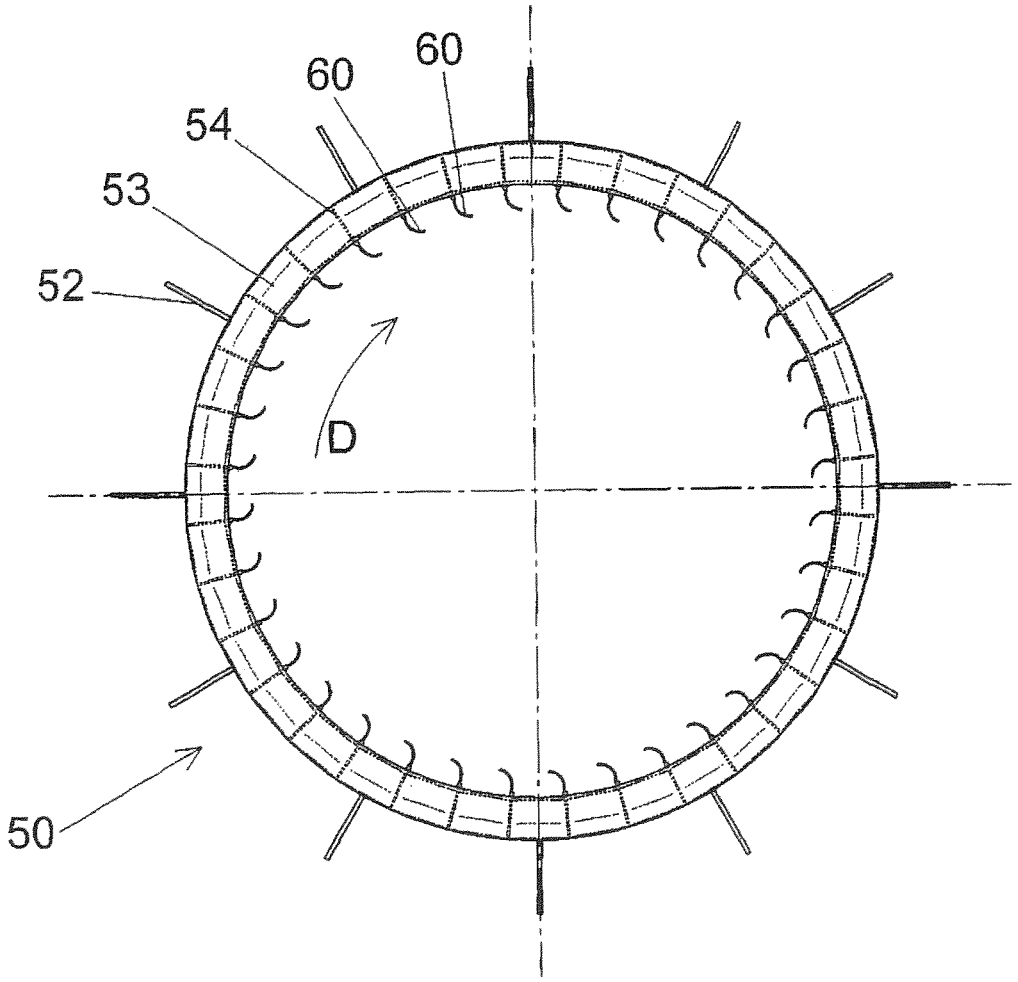
FIG. 10 the guide vane assembly of FIG. 9 in a top view.

FIG. 9 shows another embodiment of the guide vane assembly 50 in a perspective representation. FIG. 10 shows the top view of the guide vane assembly 50 represented in FIG. 9.

The flap elements 60 have a curvature in the direction of the inner circumference of the guide vane assembly 50. In FIG. 10, the direction of rotation D of the separator wheel (not shown) is drawn. The free ends of the flap elements point in the direction of rotation D.

Figure 11:
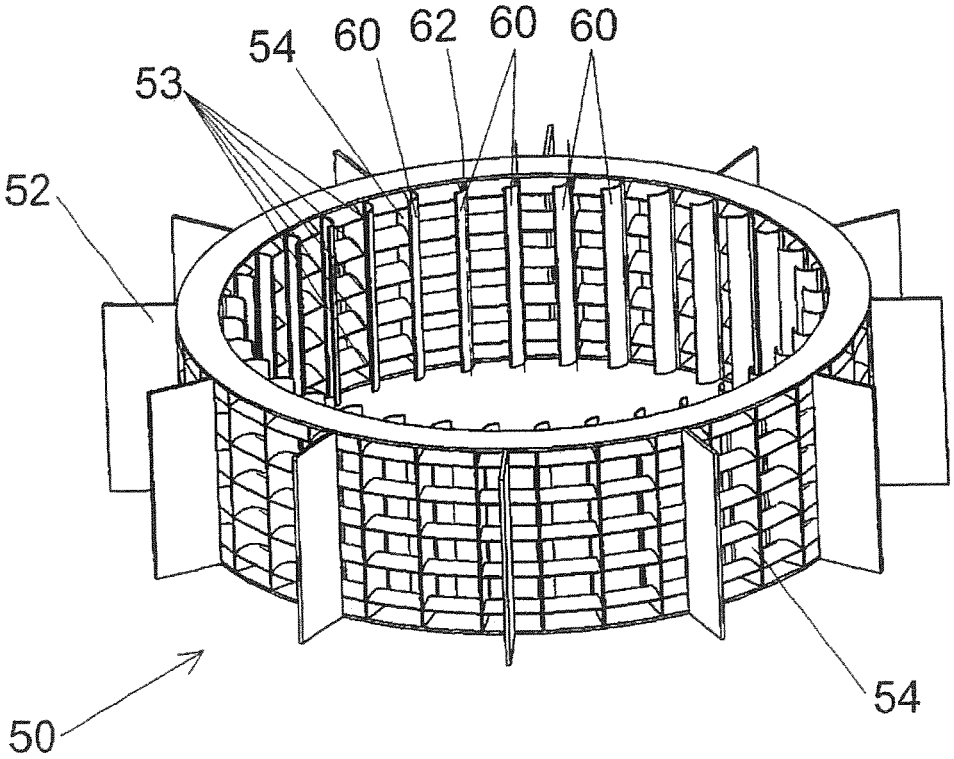
FIG. 11 a guide vane assembly according to another embodiment in a perspective representation.
Figure 12:
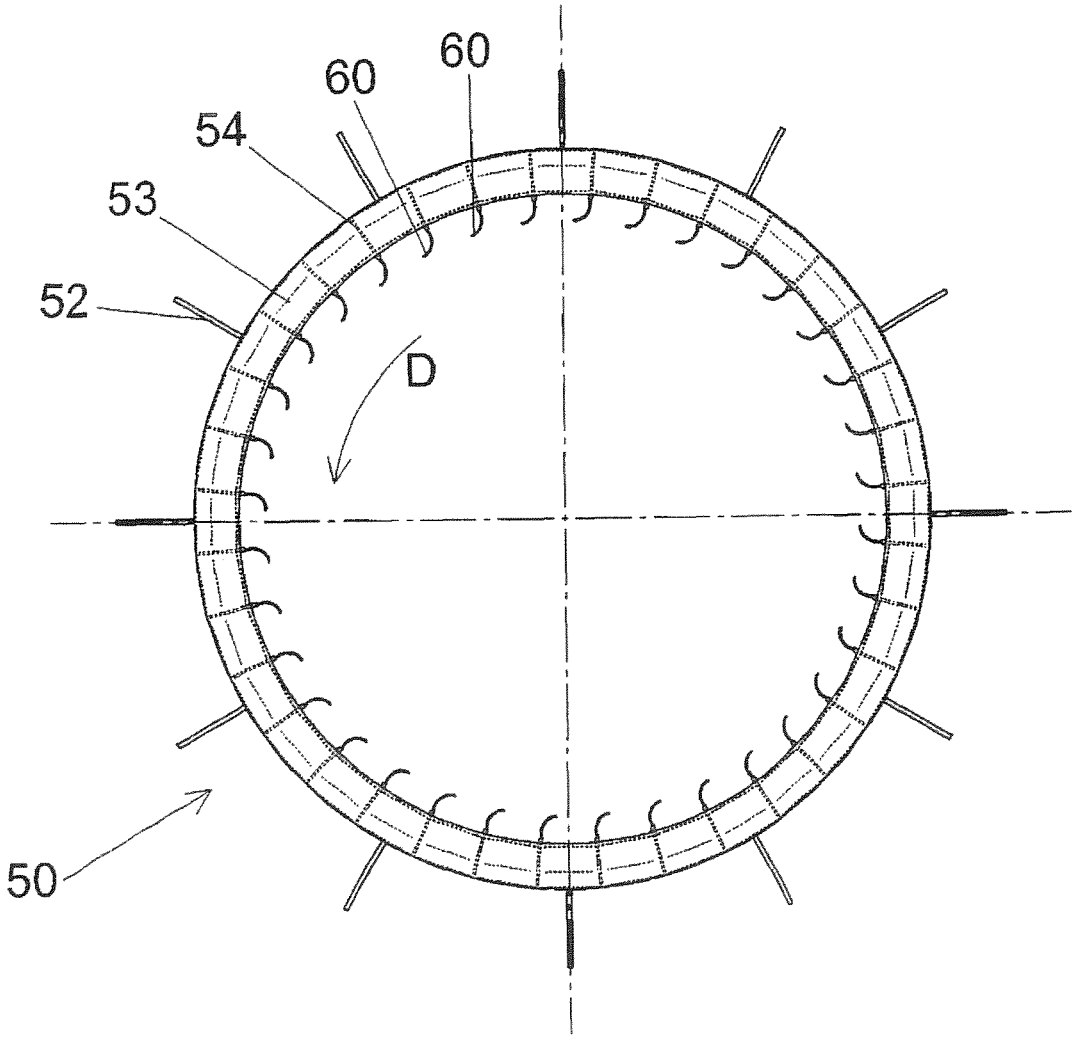
FIG. 12 the guide vane assembly of FIG. 11 in a top view.

FIG. 11 shows another embodiment of the guide vane assembly 50 in a perspective representation. FIG. 12 shows the top view of the guide vane assembly 50 represented in FIG. 11.

The flap elements 60 have a curvature in the direction of the inner circumference of the guide vane assembly 50. In FIG. 12, the direction of rotation D of the separator wheel (not shown) Is drawn. The free ends of the flap elements likewise point in the direction of rotation D, while the separator wheel rotates counterclockwise, contrary to FIGS. 9 and 10.

Figure 13:
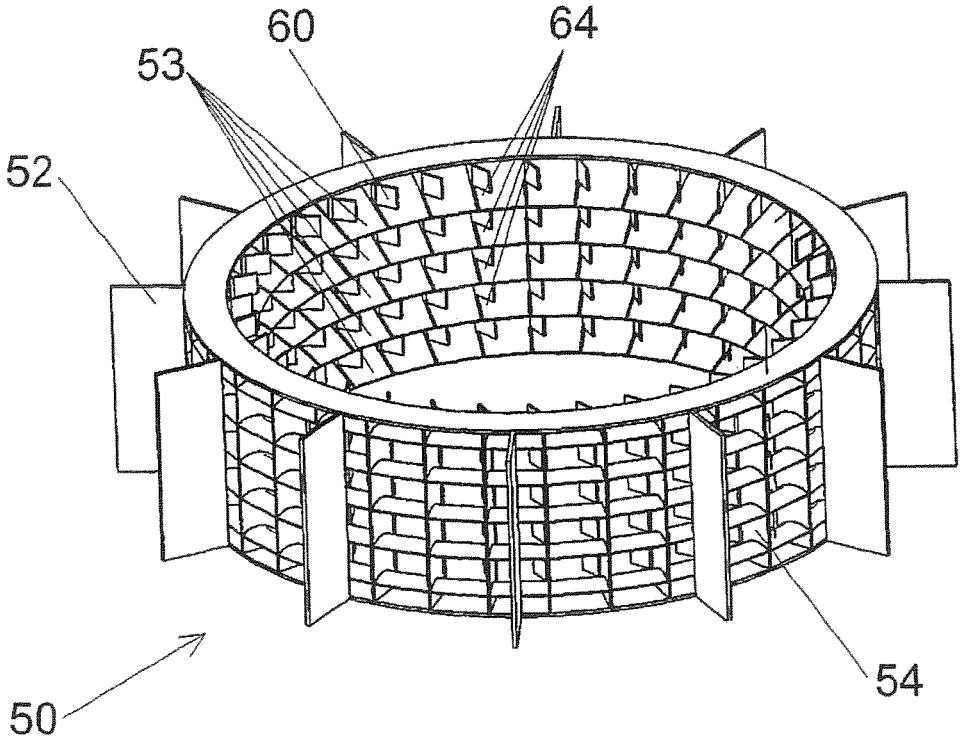
FIG. 13 a guide vane assembly according to another embodiment in a perspective representation.
Figure 14:
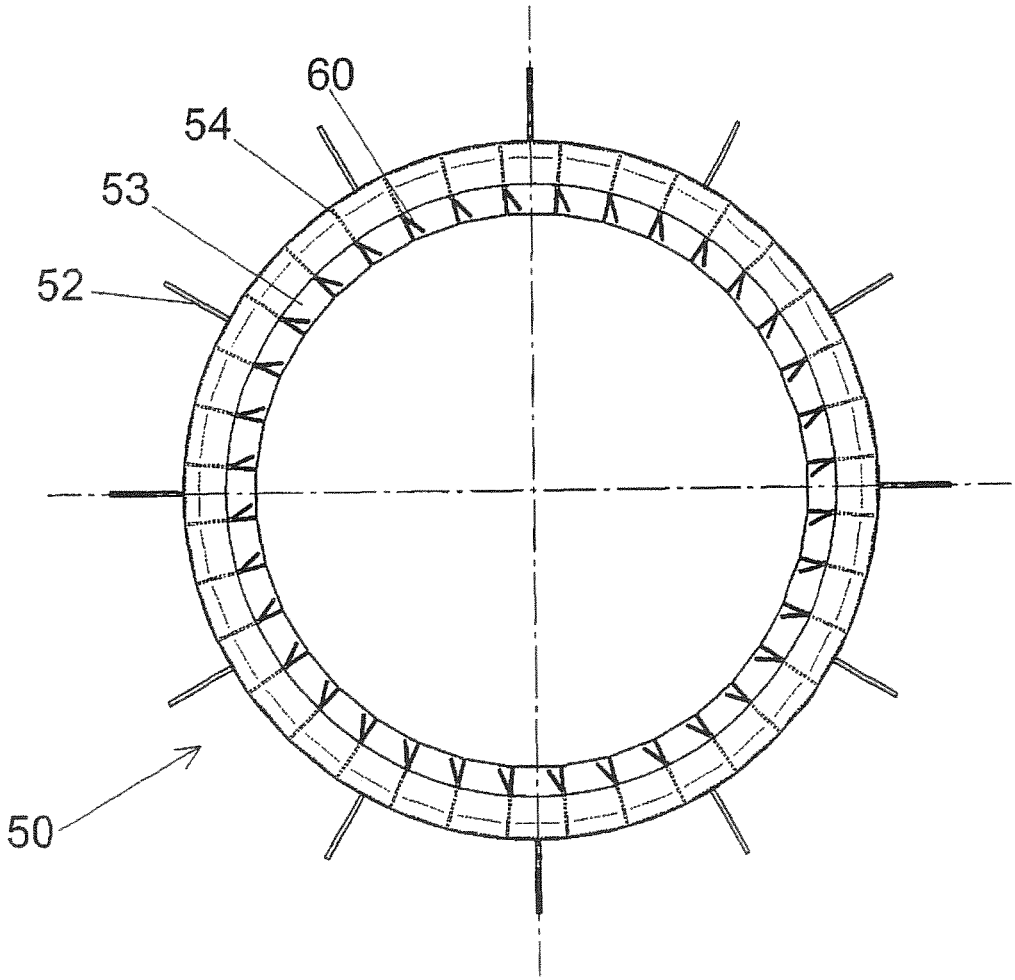
FIG. 14 the guide vane assembly of FIG. 13 in a top view.

FIG. 13 shows another embodiment of the guide vane assembly 50 in a perspective representation. FIG. 14 shows the top view of the guide vane assembly 50 represented in FIG. 13.

In this embodiment, the deflecting elements 53 protrude by their radially inner end 55 into the separating zone 32 (see FIG. 3). In order to enable the swiveling of the flap elements 60, these are provided with horizontal slots 64. Since five deflecting elements 53 are arranged between every two vertical guide vanes 54, each flap element 60 has four slots 64.

Figure 15:
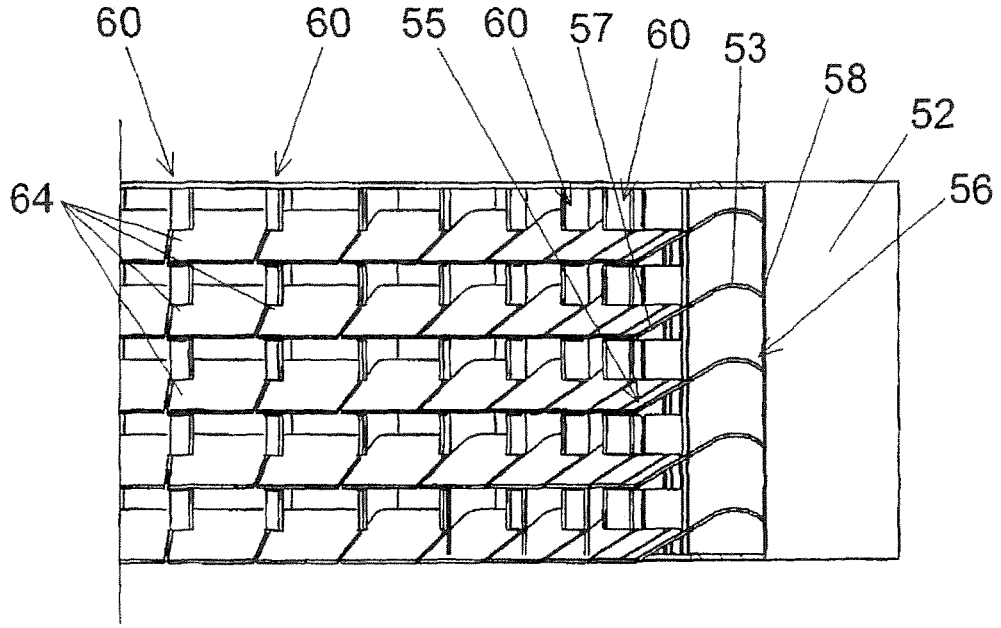
FIG. 15 an enlarged cut-out of the guide vane assembly shown in FIGS. 13 and 14.
Figure 16:
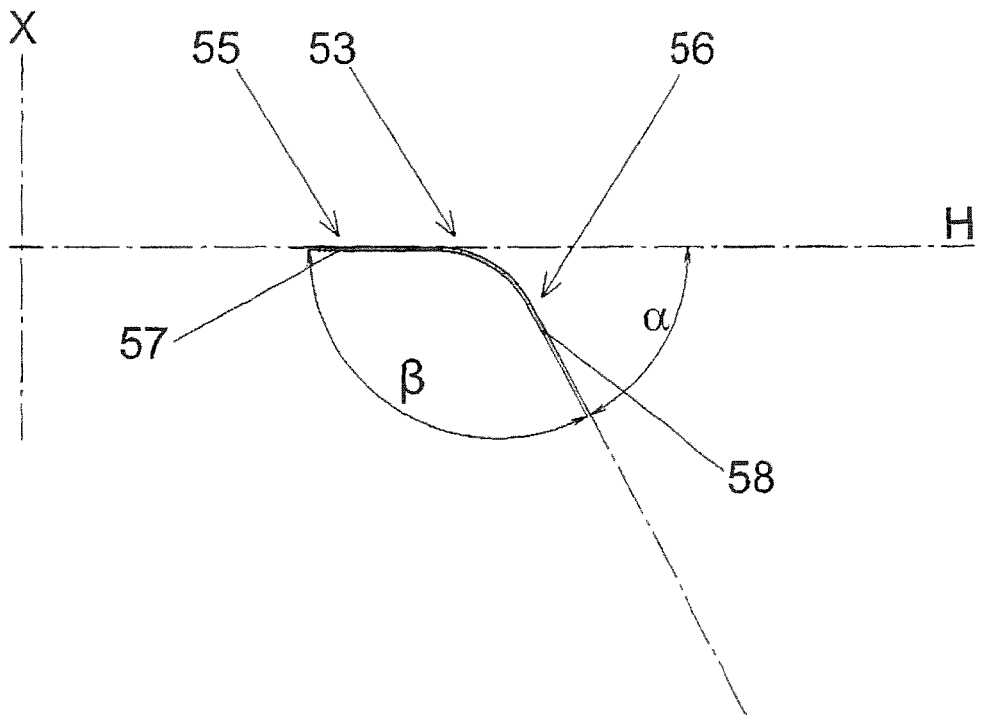
FIGS. 16 to 22 various embodiments of deflecting elements in side view.
Figure 17:
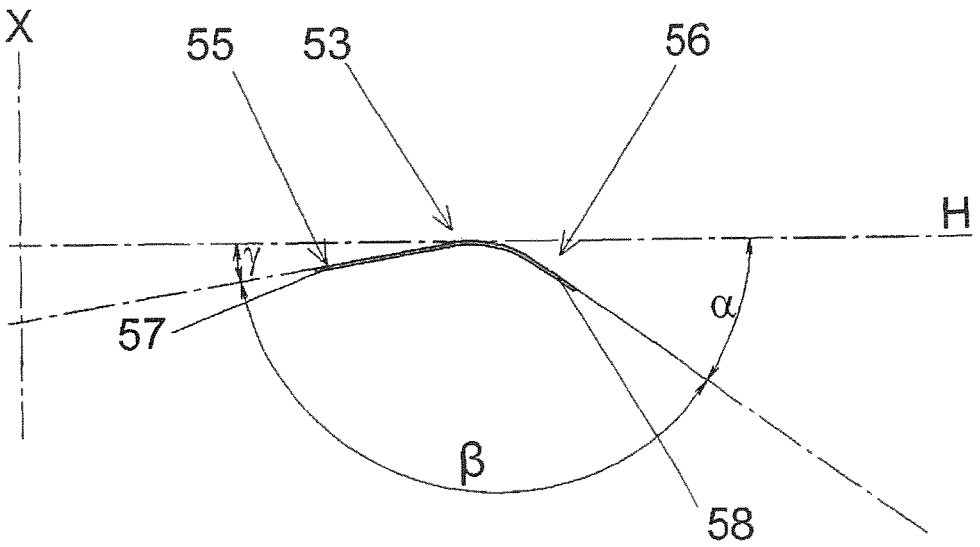
Figure 18:
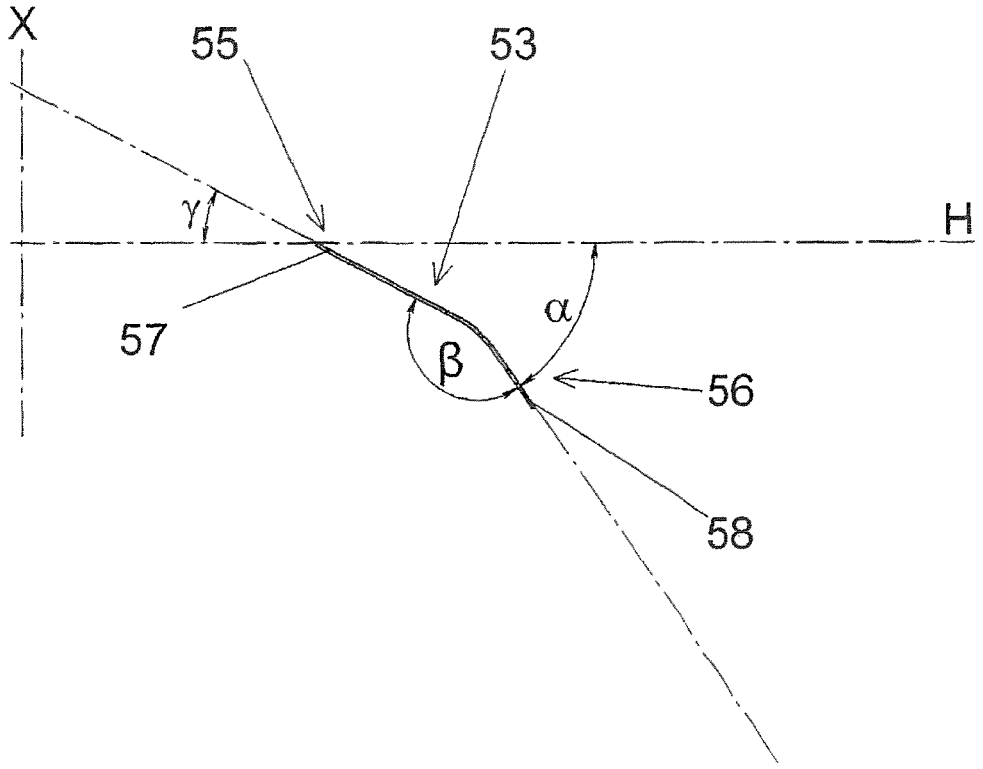
Figure 19:
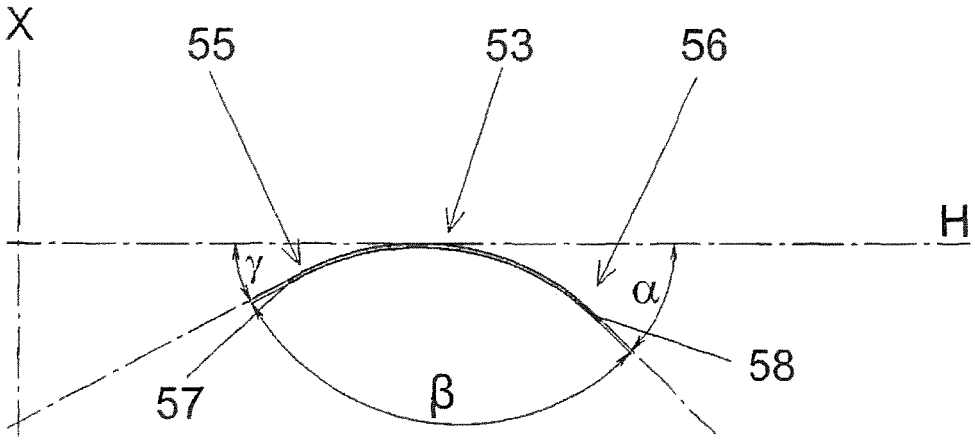
Figure 20:
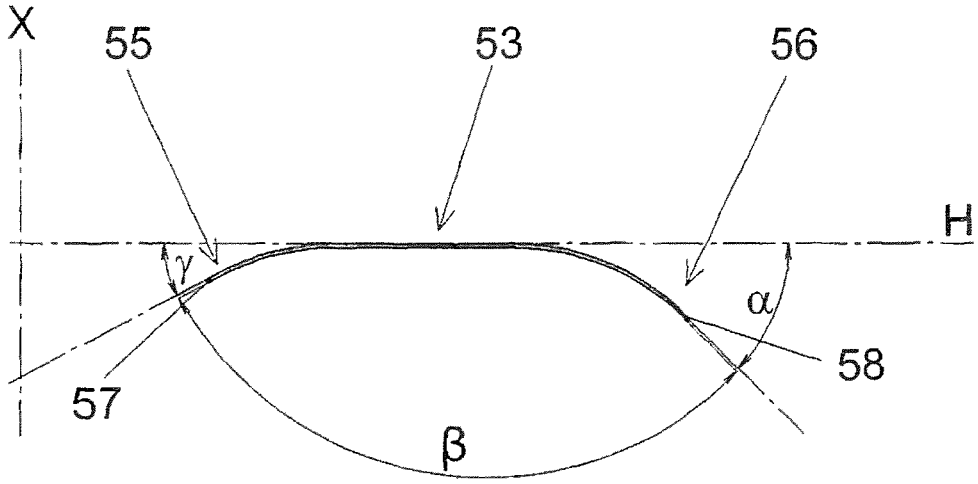

FIG. 15 shows an enlarged cut-out of the guide vane assembly 50 represented in FIGS. 13 and 14.

FIGS. 16 to 22 show different embodiments of a deflecting element 53. The deflecting elements 53 each have a radial inner end 55 and a radial outer end 56. The radial inner end 55 has a first end section 57 and the radial outer end 56 has a second end section 58. The deflecting elements 53 have a downwardly directed curvature (see FIGS. 16 to 20) or a downwardly directed bend (see FIGS. 21 and 22).

The deflecting elements 53 are arranged relative to an axis of rotation X of the separator wheel (not shown here), the spacing between deflecting element 53 and axis of rotation X being shown smaller here for drawing reasons.

Figure 21:
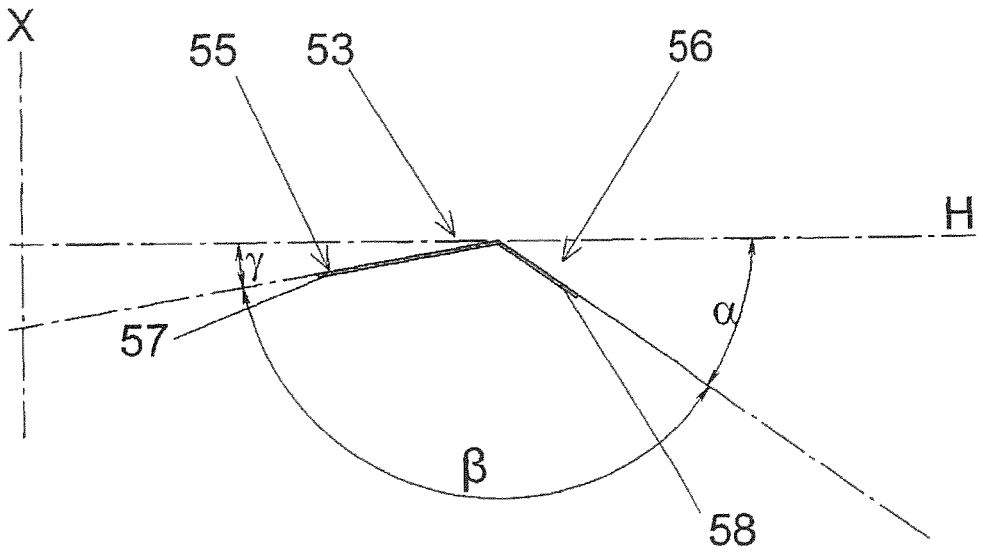
Figure 22:
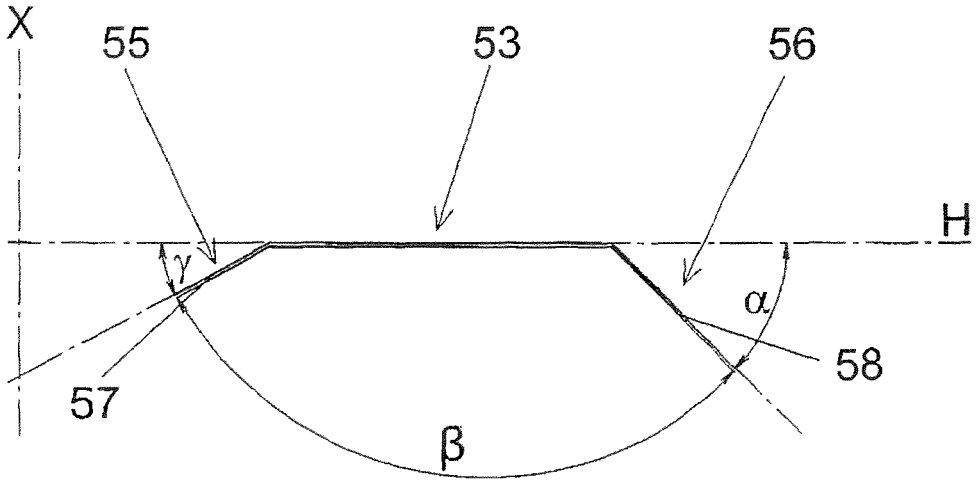

The embodiments shown in FIGS. 16 to 22 differ in particular in the configuration of the end sections 57, 58. The end sections 57, 58 may both be curved (see FIGS. 16 to 18) or both be straight (see FIGS. 20 to 22), while also straight and/or curved end sections may be joined together across a curved middle section. FIGS. 21 and 22 show deflecting elements 53 with bends.

The first end section 57 of each deflecting element 53 or its tangential prolongation (see FIG. 19) is situated at an angle γ to the horizontal H. The angle γ in the embodiments shown is between 0° (see FIG. 16) and around 28° (see, e.g., FIG. 20). The horizontal H, which corresponds to the radial direction R, makes a right angle with the axis of rotation X.

The second end section 58 of each deflecting element 53 or its tangential prolongation (see FIGS. 16, 17, 19. 20 for example) is situated at an angle α to the horizontal H. The angle α in the embodiments shown is between around 35° (see, e.g., FIG. 17) and around 65° (see FIG. 16).

The first end section 57 and the second end section 58 of a deflecting element 53 or its tangential prolongations make an angle M. The angle β in the embodiments shown is between around 108° (see FIG. 20) and around 153° (see FIG. 18).

The angles α, β and γ in the embodiments shown add up to 180°. With the exception of angle γ in FIG. 18, all angles α, β, γ point downward.

Figure 23:
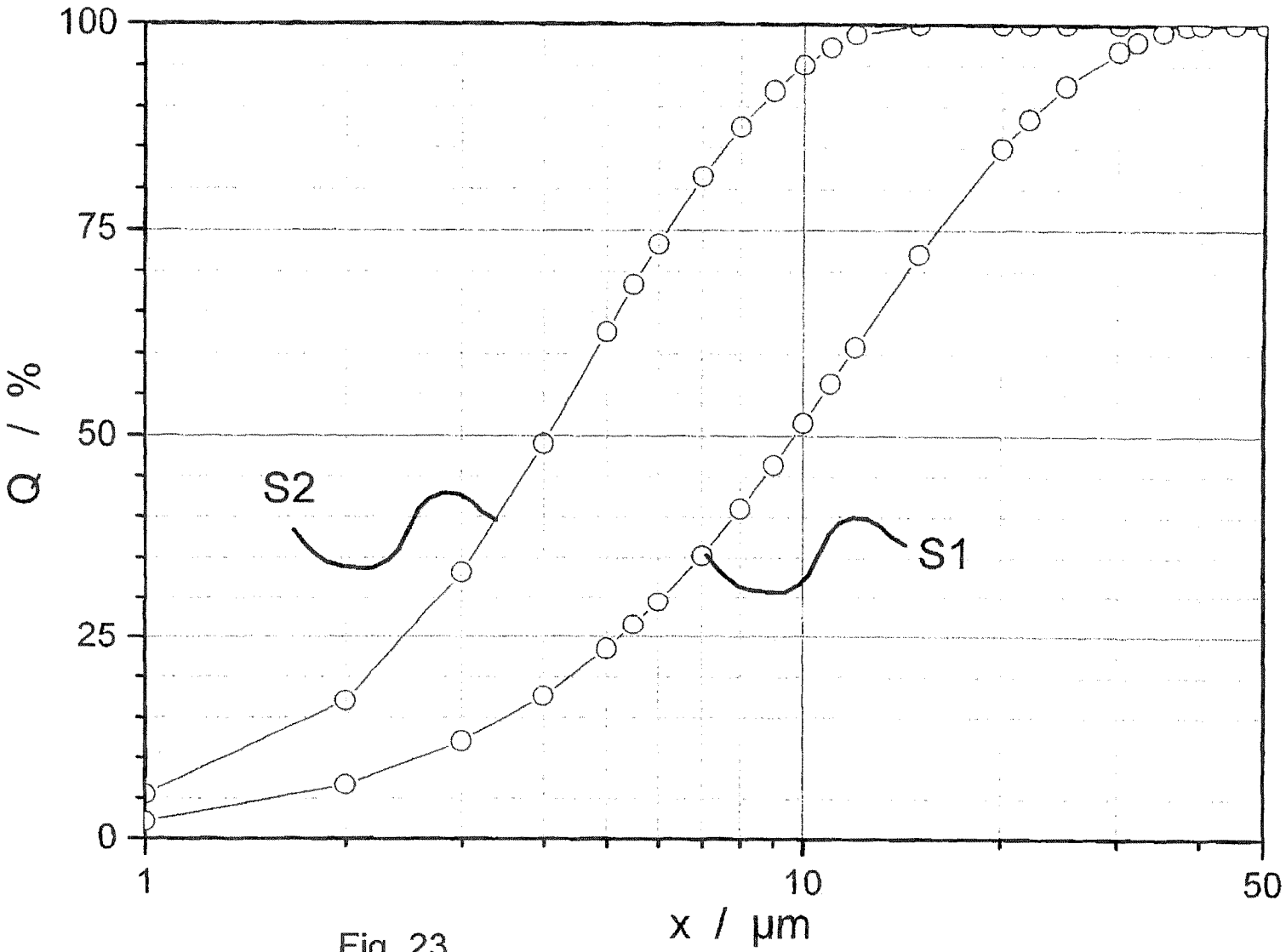
FIG. 23 a diagram of the volume flow fraction plotted against particle size.

FIG. 23 shows the particle size distribution of the fine material from two separations S1 and S2. The measurements were done preferably by means of sedimentation analysis.

The feedstock for the two separations S1 and S2 was identical in terms of the particle size distribution.

The first separation S1 was performed with a conventional separator. In the first separation S1, 97% of the particles have a particle size x<28 μm. Somewhat above 50% of the particles were smaller than 10 μm and somewhat below 25% were <5 μm.

In the second separation S2, a separator according to the invention was used. This differs from the separator of the first separation S1 in particular in that four deflecting elements with downward pointing curvatures per FIG. 4 to 6 are present each time between the vertical adjacent guide vanes.

The second separation S2 shows that an improvement in the particle size distribution is achieved thanks to the invention.

In separation S2, 97% of the particles were smaller than 10.9 μm. Nearly 75% have a particle size x<6 μm and nearly 50% of the particles have a particle size x<4 μm.

LIST OF REFERENCE SYMBOLS

10 Separator
20 Separator housing
20' Conical separator housing
21 Inlet
22 First outlet
23 Second outlet
24 Housing cover
25 Funnel
26 Annular space
30 Separator wheel
32 Separating zone
40 Drive device
50 Guide vane assembly
52 Swirl breaker
53 Deflecting element
54 Vertical guide vane
55 Radial inner end
56 Radial outer end
57 First end section
58 Second end section
59 End face of the vertical guide vane
60 Flap element
62 Vertical swivel axis
64 Slot
100 Gas-solids mixture
101 First particle variety (fine material)
102 Second particle variety (coarse material)
F Force of gravity
H Horizontal
Q Inlet volume flow
R Radial direction
S1 First separation
S2 Second separation
X Axis of rotation
α Angle
β Angle
γ Angle

What is claimed is:

1. A separator, comprising a separator housing, a separator wheel arranged inside the separator housing and having an axis of rotation (X), and a guide vane assembly arranged in the separator housing, wherein an annular space for an upward flowing gas-solids mixture is provided between the guide vane assembly and the separator housing in the radial direction (R) perpendicular to the axis of rotation (X) and a separation zone is provided between the guide vane assembly and the separator wheel, wherein the guide vane assembly comprises a plurality of vertical guide vanes, wherein multiple for deflectors for deflecting the gas-solids mixture towards the separation zone are arranged between at least two adjacent vertical guide vanes, wherein each deflector of the multiple deflectors has at least one downward-pointing curved and/or bent portion, wherein each deflector has a radial inner end with a first end section and a radial outer end with a second end section, wherein the first end section and the second end section are directed downward such that the second end section located at the radial outer end of the deflector is directed towards the upward flowing gas-solids mixture, wherein each vertical guide vane has a radial inner end and a radial outer end, and wherein the deflector radial inner end and deflector radial outer end are located between the vertical guide vane radial inner end and vertical guide vane radial outer end, wherein at least one vertical flap element extending into the separating zone is arranged on an inner circumference of the guide vane assembly, wherein the flap element swivels about a vertical axis, wherein the flap element is arranged on an inner end face of the vertical guide vane, wherein a length of the flap element is equal to a length of the vertical guide vane and wherein the guide vane assembly has at least one swirl breaker.

2. The separator as claimed in claim 1, wherein at least one of the deflectors extends over the entire width between two neighboring guide vanes.

3. The separator as claimed in claim 1, wherein at least one of the deflectors has a variable radius of curvature in a partial section in the radial direction (R) of the guide vane assembly.

4. The separator as claimed in claim 1, wherein at least one of the first and second end sections is straight.

5. The separator as claimed in claim 1, wherein at least one second end section of the multiple deflectors is an arc, with a straight prolongation, which is tangential to a curvature at an end point of the second end section, runs at an angle (α) to a horizontal, whereby α≥20°.

6. The separator as claimed in claim 1, wherein at least one first end section of the multiple deflectors is an arc with a straight prolongation, which is tangential to a curvature at an end point of the first end section, and at least one second end section of the same deflector is an arc with a straight prolongation which is tangential to a curvature at an end point of the second end section, run together at an angle (β), where β≥90°.

7. The separator as claimed in claim 1, wherein at least one first end section of the multiple deflectors is an arc with a straight prolongation, which is tangential to a curvature at an end point of the first end section, runs at an angle (γ) to the horizontal, while: γ≥10°.

8. The separator as claimed in claim 1, wherein at least three to five of the multiple deflectors are arranged between every two neighboring vertical guide vanes.

9. The separator as claimed in claim 8, wherein the flap element has at least one horizontal slot.

10. The separator as claimed in claim 8, wherein the at least one flap element has a curvature and/or a bending.

11. The separator as claimed in claim 1, wherein the separator housing is conical.

12. A mill having the separator as claimed in claim 1.

* * * * *